US008616838B2

(12) United States Patent
Chiu et al.

(10) Patent No.: US 8,616,838 B2
(45) Date of Patent: Dec. 31, 2013

(54) SYSTEMS AND APPARATUS RELATING TO COMPRESSOR OPERATION IN TURBINE ENGINES

(75) Inventors: Ya-Tien Chiu, Greer, SC (US); Venkata S. P. Chaluvadi, Simpsonville, SC (US); Peter S. King, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 841 days.

(21) Appl. No.: 12/650,837

(22) Filed: Dec. 31, 2009

(65) Prior Publication Data

US 2011/0158797 A1 Jun. 30, 2011

(51) Int. Cl.
*F01D 5/02* (2006.01)

(52) U.S. Cl.
USPC ..... 415/168.4; 415/168.1

(58) Field of Classification Search
USPC ..... 416/174, 175, 198 A, 224, 239; 415/168.1, 168.2, 168.4, 173.7, 174.5
See application file for complete search history.

(56) References Cited

U.S. PATENT DOCUMENTS 5,211,533 A * 5/1993 Walker et al. ..... 415/115
5,288,210 A * 2/1994 Albrecht et al. ..... 416/198 A
6,077,035 A * 6/2000 Walters et al. ..... 415/115
6,857,851 B2 * 2/2005 Avignon et al. ..... 415/116
2006/0269398 A1 11/2006 Marini et al.
2006/0269399 A1 11/2006 Girgis et al.
2006/0269400 A1 11/2006 Girgis et al.
2011/0158797 A1 * 6/2011 Chiu et al. ..... 415/208.2

FOREIGN PATENT DOCUMENTS

DE 956822 C 1/1957
DE 102008011746 A1 9/2009
EP 2116692 A2 11/2009
JP 09317696 A * 12/1997

OTHER PUBLICATIONS

European Search Report.

* cited by examiner

*Primary Examiner* — Edward Look
*Assistant Examiner* — Christopher R Legendre
(74) *Attorney, Agent, or Firm* — Mark E. Henderson; Ernest G. Cusick; Frank A. Landgraff

(57) ABSTRACT

A compressor of a turbine engine, the compressor including stator blades with shrouds, the shrouds being surrounded, at least in part, by rotating structure and forming a shroud cavity therebetween, the compressor including: a plurality of tangential flow inducers disposed within the shroud cavity; wherein each tangential flow inducer comprises a surface disposed on the rotating structure that is configured such that, when rotated, induces a tangential directional component to and/or increases the velocity of a flow of leakage exiting the shroud cavity.

19 Claims, 7 Drawing Sheets

SYSTEMS AND APPARATUS RELATING TO COMPRESSOR OPERATION IN TURBINE ENGINES

BACKGROUND OF THE INVENTION

This present application relates generally to systems and apparatus for improving the efficiency and/or operation of turbine engines. More specifically, but not by way of limitation, the present application relates to improved systems and apparatus pertaining to compressor operation and, in particular, the efficient reintroduction of leakage flow into the main flow path.

As will be appreciated, the performance of a turbine engine is largely affected by its ability to eliminate or reduce leakage that occurs between stages in both the turbine and compressor sections of the engine. In general, this is caused because of the gaps that exist between rotating and stationary components. More specifically, in the compressor, leakage generally occurs through the cavity that is defined by the shrouds of compressor stator blades, which are stationary, and the rotating barrel that opposes and substantially surrounds the shroud. Flowing from higher pressure to lower, this leakage results in a flow that is in a reverse direction of the flow in the main flow path. That is, the flow enters the shroud cavity from a downstream side of the shroud and flows in an upstream direction where it is discharged back into the main flow from an upstream side of the shroud.

Of course, seals are employed to limit this flow. However, given that one surface is in motion and the other is stationary, conventional seals are unable to prevent much of this leakage flow from occurring. The reduction of the gap between stationary and rotating structures is desirable, but its elimination is usually not practical due to inevitable different thermal characteristics between the rotating and stationary components, as well as the centrifugal characteristics of the rotating components. With the added considerations of component manufacturing tolerances and variation in operating conditions, which govern thermal and centrifugal characteristics, it is generally the case that a leakage gap forms during at least certain operating conditions. Of course, leakage generally results from a pressure difference that exists across a leakage gap. However, while it might be possible to reduce the pressure difference across the leakage gap, this generally comes at too high a price, as it places an undesirable limitation on the aerodynamic design of working fluid velocity components.

It will be appreciated that compressor leakage of this nature decreases the efficiency of the engine in at least two appreciable ways. First, the leakage itself decreases the pressure of the main flow through the compressor and, thus, increases the energy that the engine must expend to raise the pressure of the main flow to desired levels before it is delivered to the combustor. Second, mixing losses occur as the leakage flow exits the shroud cavity and reenters the main flow path.

As one of ordinary skill in the art will appreciate, mixing losses of this type may be significant and result in appreciable losses in compressor efficiency. One reason why mixing losses are relatively high is because, at the point of mixture, the leakage flow and the main flow are flowing in dissimilar directions and/or dissimilar velocities. More particularly, the main flow, having just passed through the rotor blades of the previous stage, flows at a relatively high velocity and with a significant tangential directional component. Whereas, the leakage flow, having negotiated the typically tortured pathway through the shroud cavity, flows at a relatively slow velocity and is directed in a primarily radial direction, and lacks the tangential directional component of the main flow.

As a result, there is a need for improved systems and apparatus that reduce the mixing loses that occur when the leakage flow reenters the main flow of the compressor.

BRIEF DESCRIPTION OF THE INVENTION

The present application thus describes a compressor of a turbine engine, the compressor including stator blades with shrouds, the shrouds being surrounded, at least in part, by a rotating structure and forming a shroud cavity therebetween, the compressor including: a plurality of tangential flow inducers disposed within the shroud cavity; wherein each tangential flow inducer comprises a surface disposed on the rotating structure that is configured such that, when rotated, induces a tangential directional component to and/or increases the velocity of a flow of leakage exiting the shroud cavity.

The present application further describes: in a compressor of a turbine engine, the compressor including stator blades with shrouds, the shrouds being surrounded, at least in part, by rotating structure and forming a shroud cavity therebetween, a plurality of flow inducers disposed at regular intervals on the rotating structure in the shroud cavity, each of the flow inducers including: a fin that includes a face; wherein the fin is configured such that the face faces toward the direction of rotation; and the fin is configured such that, when rotated, induces a tangential directional component to a flow of leakage exiting the shroud cavity flow.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
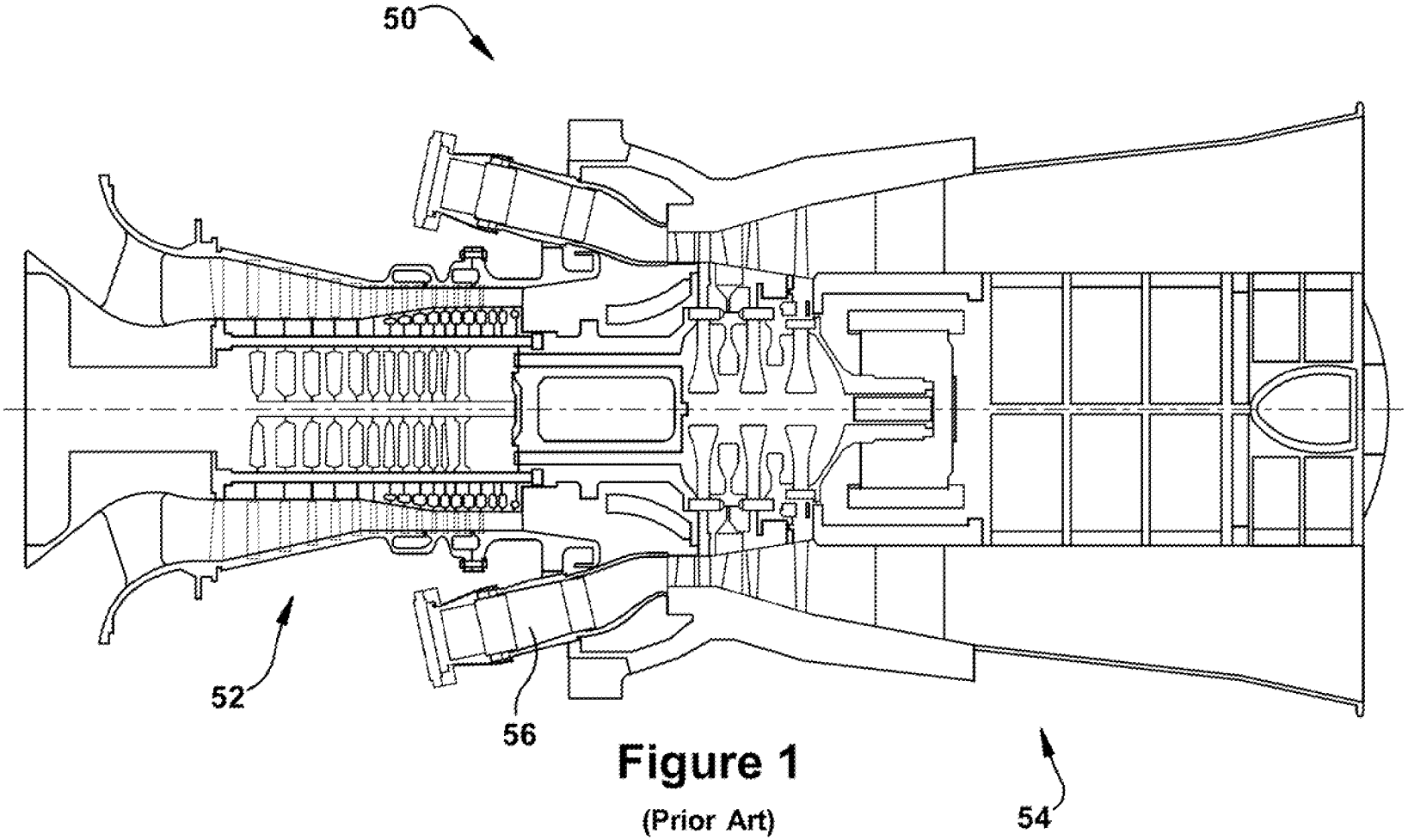
Figure 1 (Prior Art)
FIG. 1 is a schematic representation of an exemplary gas turbine engine in which embodiments of the present application may be used.
Figure 2:
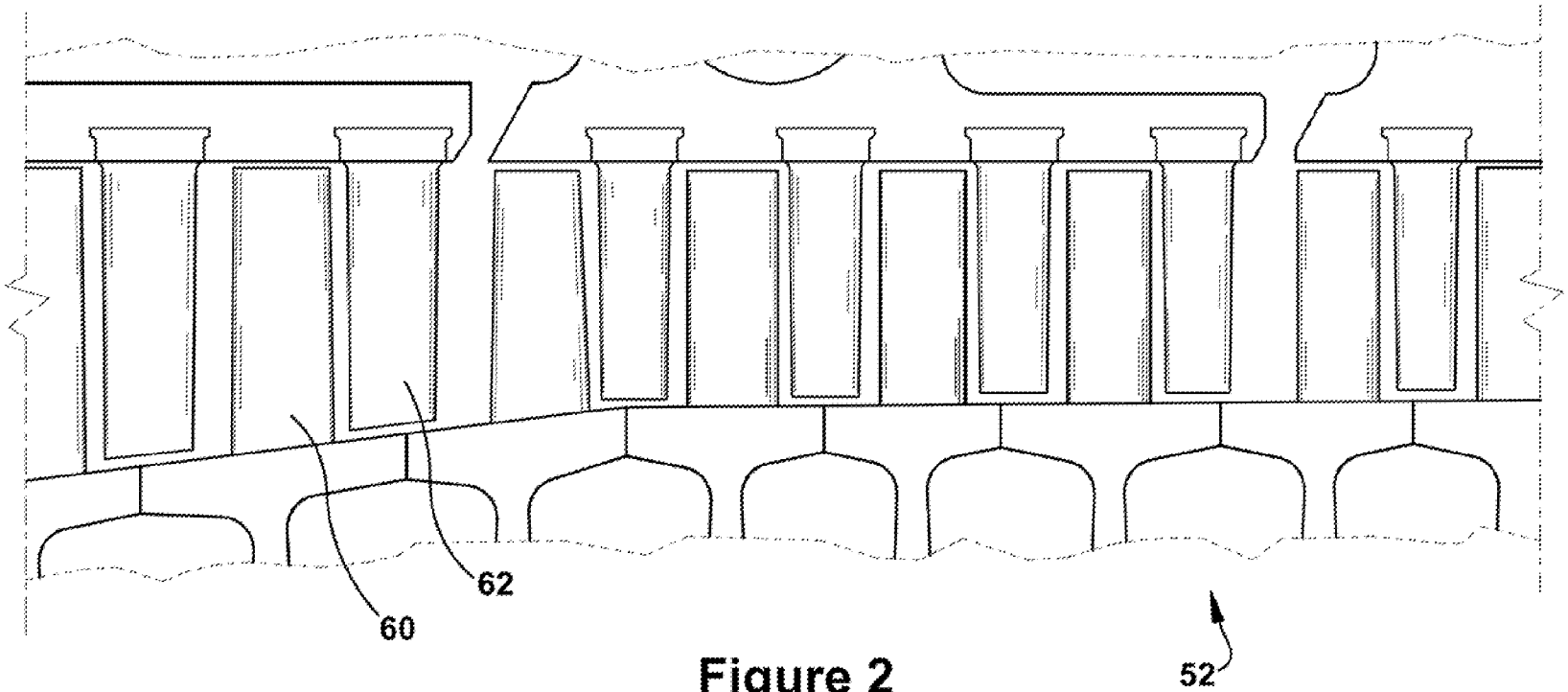
Figure 2 (Prior Art)
FIG. 2 is a sectional view of the compressor in the gas turbine engine of FIG. 1.
Figure 3:
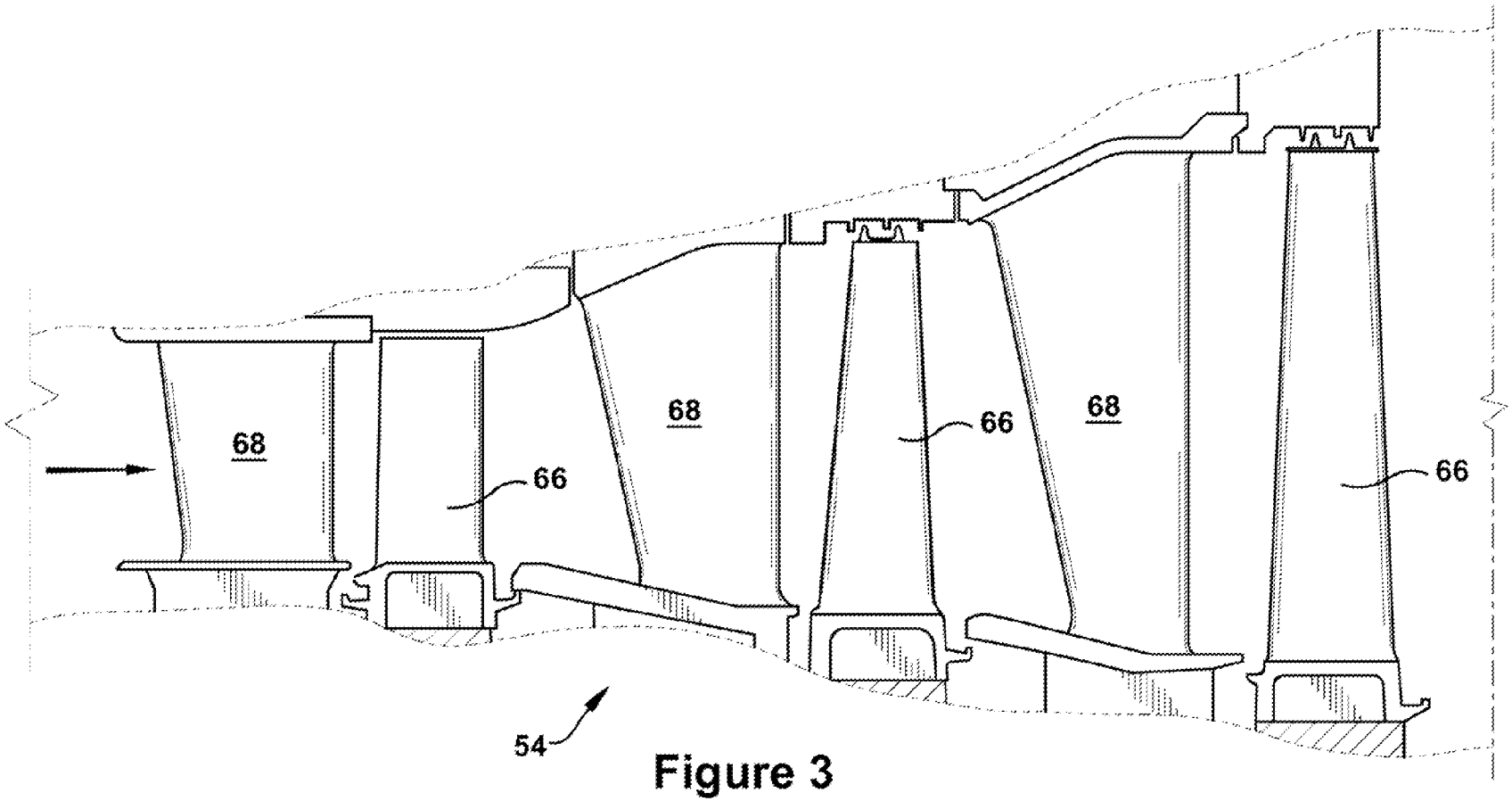
Figure 3 (Prior Art)
FIG. 3 is a sectional view of the turbine in the gas turbine engine of FIG. 1.

By way of background, referring now to the figures, FIGS. 1 through 3 illustrate an exemplary gas turbine engine in which embodiments of the present application may be used. FIG. 1 is a schematic representation of a gas turbine engine 50. In general, gas turbine engines operate by extracting energy from a pressurized flow of hot gas that is produced by the combustion of a fuel in a stream of compressed air. As illustrated in FIG. 1, gas turbine engine 50 may be configured with an axial compressor 52 that is mechanically coupled by a common shaft or rotor to a downstream turbine section or turbine 54, and a combustor 56 positioned between the compressor 52 and the turbine 54.

Figure 4:
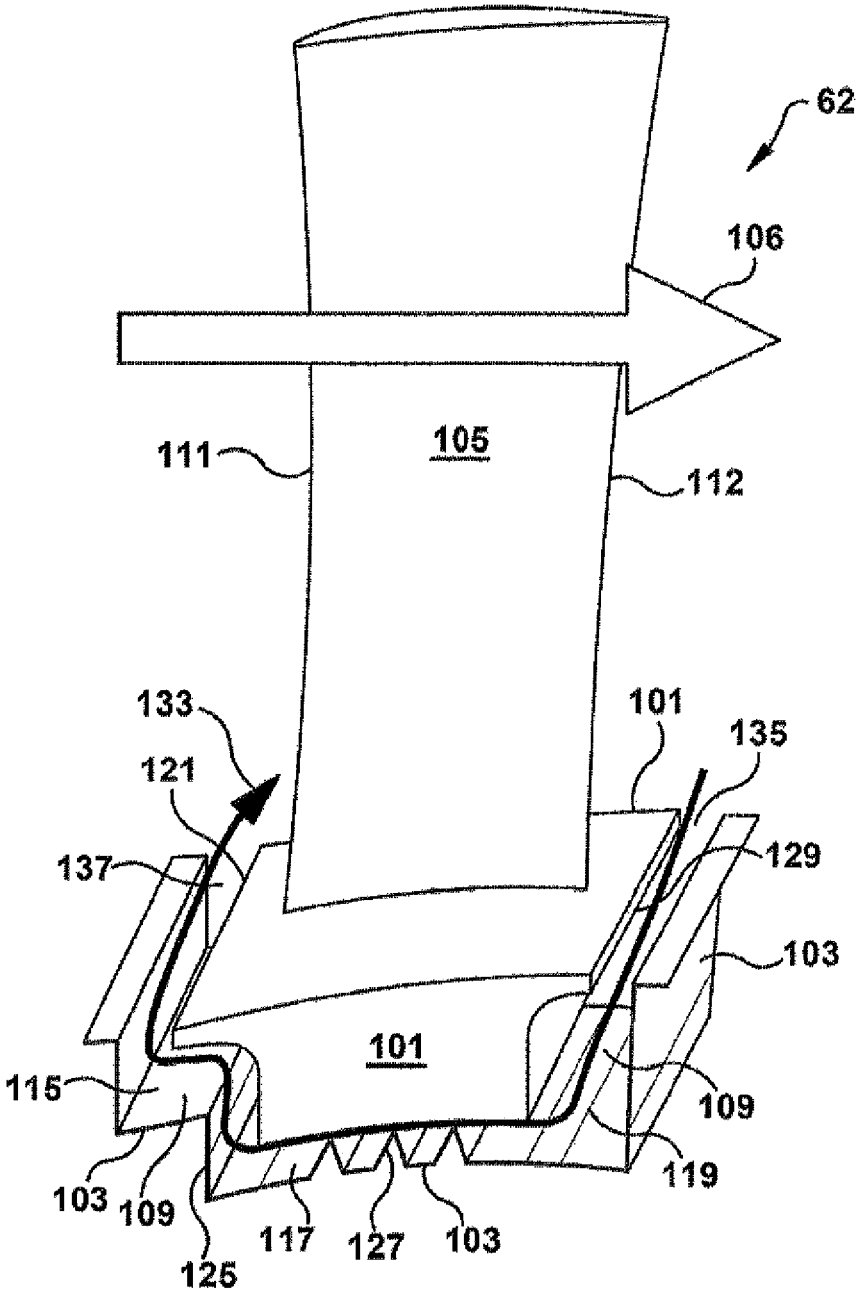
Figure 4 (Prior Art)
FIG. 4 is a view of a conventional shroud cavity.

FIG. 2 illustrates a view of an exemplary multi-staged axial compressor 52 that may be used in the gas turbine engine of FIG. 1. As shown, the compressor 52 may include a plurality of stages. Each stage may include a row of compressor rotor blades 60 followed by a row of compressor stator blades 62. (Note, though not shown in FIG. 2, compressor stator blades 62 may be formed with shrouds, an example of which is shown in FIG. 4.) Thus, a first stage may include a row of compressor rotor blades 60, which rotate about a central shaft, followed by a row of compressor stator blades 62, which remain stationary during operation. The compressor stator blades 62 generally are circumferentially spaced one from the other and fixed about the axis of rotation. The compressor rotor blades 60 are circumferentially spaced and attached to the shaft; when the shaft rotates during operation, the compressor rotor blades 60 rotate about it. As one of ordinary skill in the art will appreciate, the compressor rotor blades 60 are configured such that, when spun about the shaft, they impart kinetic energy to the air or fluid flowing through the compressor 52. The compressor 52 may have other stages beyond the stages that are illustrated in FIG. 2. Additional stages may include a plurality of circumferential spaced compressor rotor blades 60 followed by a plurality of circumferentially spaced compressor stator blades 62.

FIG. 3 illustrates a partial view of an exemplary turbine section or turbine 54 that may be used in the gas turbine engine of FIG. 1. The turbine 54 also may include a plurality of stages. Three exemplary stages are illustrated, but more or less stages may present in the turbine 54. A first stage includes a plurality of turbine buckets or turbine rotor blades 66, which rotate about the shaft during operation, and a plurality of nozzles or turbine stator blades 68, which remain stationary during operation. The turbine stator blades 68 generally are circumferentially spaced one from the other and fixed about the axis of rotation. The turbine rotor blades 66 may be mounted on a turbine wheel (not shown) for rotation about the shaft (not shown). A second stage of the turbine 54 also is illustrated. The second stage similarly includes a plurality of circumferentially spaced turbine stator blades 68 followed by a plurality of circumferentially spaced turbine rotor blades 66, which are also mounted on a turbine wheel for rotation. A third stage also is illustrated, and similarly includes a plurality of turbine stator blades 68 and rotor blades 66. It will be appreciated that the turbine stator blades 68 and turbine rotor blades 66 lie in the hot gas path of the turbine 54. The direction of flow of the hot gases through the hot gas path is indicated by the arrow. As one of ordinary skill in the art will appreciate, the turbine 54 may have other stages beyond the stages that are illustrated in FIG. 3. Each additional stage may include a row of turbine stator blades 68 followed by a row of turbine rotor blades 66.

In use, the rotation of compressor rotor blades 60 within the axial compressor 52 may compress a flow of air. In the combustor 56, energy may be released when the compressed air is mixed with a fuel and ignited. The resulting flow of hot gases from the combustor 56, which may be referred to as the working fluid, is then directed over the turbine rotor blades 66, the flow of working fluid inducing the rotation of the turbine rotor blades 66 about the shaft. Thereby, the energy of the flow of working fluid is transformed into the mechanical energy of the rotating blades and, because of the connection between the rotor blades and the shaft, the rotating shaft. The mechanical energy of the shaft may then be used to drive the rotation of the compressor rotor blades 60, such that the necessary supply of compressed air is produced, and also, for example, a generator to produce electricity.

It will be appreciated that to communicate clearly the invention of the current application, it may be necessary to select terminology that refers to and describes certain machine components or parts of a turbine engine. Whenever possible, common industry terminology will be used and employed in a manner consistent with its accepted meaning. However, it is meant that any such terminology be given a broad meaning and not narrowly construed such that the meaning intended herein and the scope of the appended claims is unreasonably restricted. Those of ordinary skill in the art will appreciate that often certain components may be referred to with several different names. In addition, what may be described herein as a single part may include and be referenced in another context as consisting of several component parts, or, what may be described herein as including multiple component parts may be fashioned into and, in some cases, referred to as a single part. As such, in understanding the scope of the invention described herein, attention should not only be paid to the terminology and description provided, but also to the structure, configuration, function, and/or usage of the component as described herein.

In addition, several descriptive terms may be used herein. The meaning for these terms shall include the following definitions. The term "rotor blade", without further specificity, is a reference to the rotating blades of either the compressor 52 or the turbine 54, which include both compressor rotor blades 60 and turbine rotor blades 66. The term "stator blade", without further specificity, is a reference to the stationary blades of either the compressor 52 or the turbine 54, which include both compressor stator blades 62 and turbine stator blades 68. The term "blades" will be used herein to refer to either type of blade. Thus, without further specificity, the term "blades" is inclusive to all type of turbine engine blades, including compressor rotor blades 60, compressor stator blades 62, turbine rotor blades 66, and turbine stator blades 68. Further, as used herein, "downstream" and "upstream" are terms that indicate a direction relative to the flow of working fluid through the turbine. As such, the term "downstream" means the direction of the flow, and the term "upstream" means in the opposite direction of the flow through the turbine. Related to these terms, the terms "aft" and/or "trailing edge" refer to the downstream direction, the downstream end and/or in the direction of the downstream end of the component being described. And, the terms "forward" and/or "leading edge" refer to the upstream direction, the upstream end and/or in the direction of the upstream end of the component being described. The term "radial" refers to movement or position perpendicular to an axis. It is often required to described parts that are at differing radial positions with regard to an axis. In this case, if a first component resides closer to the axis than a second component, it may be stated herein that the first component is "inboard" or "radially inward" of the second component. If, on the other hand, the first component resides further from the axis than the second component, it may be stated herein that the first component is "outboard" or "radially outward" of the second component. The term "axial" refers to movement or position parallel to an axis. And, the term "circumferential" refers to movement or position around an axis.

Referring again to the figures, FIG. 4 illustrates a stator blade 62 having a conventional shroud 101. As depicted, a structure that rotates during operation of the turbine engine (referred to herein as rotating structure 103) surrounds the shroud 101. It will be appreciated that the stator blade 62 is stationary and connects to an outer casing (not shown) of the turbine engine. This connection desirably positions an airfoil 105 of the blade 62 within the flow path or main flow (indicated by arrow 106) of the compressor. The stator blade 62 has a leading edge 111 and a trailing edge 112, which are thusly named based upon the direction of the main flow, and the stator blade 62 terminates at the shroud 101. For reasons discussed, while the rotating structure 103 generally surrounds the stationary shroud 101, gaps generally are maintained between the two components. These gaps generally form what is referred to herein as a shroud cavity 109. It will be appreciated that the function of the shroud 101 generally includes connecting the stator blades 62 within a particular row along an inner diameter, providing a surface to define the inner boundary of the flowpath, and/or forming seals with the opposing rotating structure that discourage leakage flow.

Though other configurations are possible, in most cases the shroud cavity 109 may be generally described as having three smaller, interconnected cavities, which may be identified given their positions relative to the shroud 101. Accordingly, the shroud cavity 109 may include an upstream cavity portion 115, an intermediate cavity portion 117, and a downstream cavity portion 119.

The upstream cavity portion 115 of the shroud cavity 109 generally refers to the axial gap that is maintained between the leading face of the shroud 101 and the surface of the rotating structure 103 that opposes it. The upstream portion of the shroud cavity also is somewhat enclosed by a leading edge flange 121 that is positioned on the shroud 101, as shown in FIG. 4. In addition, in some cases, and as shown in FIG. 4, the upstream cavity portion 115 may include a step 125 that is formed within the rotating structure that opposes the leading face of the shroud.

The intermediate cavity portion 117 of the shroud cavity 109, as shown, may be described as the radial gap between the inboard face of the shroud 101 and the surface of the rotating structure that opposes it. It will be appreciated that it is within the intermediate portion of shroud cavity that seals are often configured, such as the knife-edge seals 127 that are shown.

The downstream cavity portion 119 of the shroud cavity 109 generally refers to the axial gap that is maintained between the trailing face of the shroud 101 and the surface of the rotating structure 103 that opposes it. The downstream cavity portion 119 may be somewhat enclosed by a trailing edge flange 129 that is typically located on the trailing edge of the shroud 101, as shown.

In operation, as described, leakage occurs through the shroud cavity 109. This leakage is generally induced by the pressure differential that exists across the stator blade 62. The leakage generally follows the following path (as indicated by arrow 133): the leakage enters the shroud cavity 109 via a downstream gap 135, then flows radially inward through the downstream cavity portion 119, then flows in an axial upstream direction ("upstream" being relative to the direction of the main flow), then flows in a radially outward direction, then exits the shroud cavity 109 via an upstream gap 137.

As one of ordinary skill in the art will appreciate, when the leakage exits the shroud cavity 109 and reenters the main flow, mixing losses occur which often are significant. One reason why these losses are generally high is because, at the point of mixture, the leakage flow and the main flow are flowing in dissimilar directions and/or dissimilar velocities. As stated, the main flow, having just passed through the rotor blades 60 of the previous stage, flows at a relatively high velocity and with a significant tangential directional component. On the other hand, the leakage is generally flowing at a slower velocity, and, given the typical configuration of convention shroud cavities 109 (one of which being illustrated in FIG. 4), the leakage is moving in a radially outward direction and, thus, generally lacks the tangential directional component of the main flow. The differences in flow velocities and/or direction increases the mixing losses.

Figure 5:
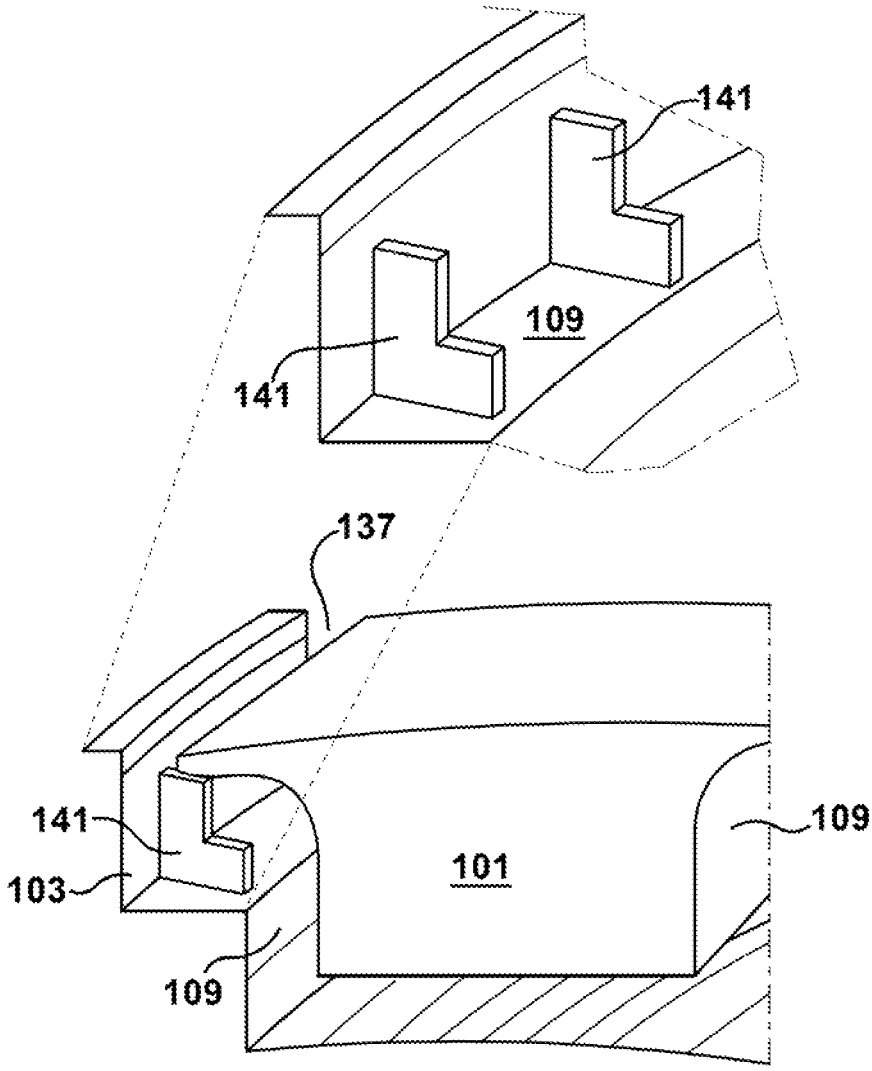
FIG. 5 is a view of a shroud cavity that includes an embodiment of the present application.
Figure 6:
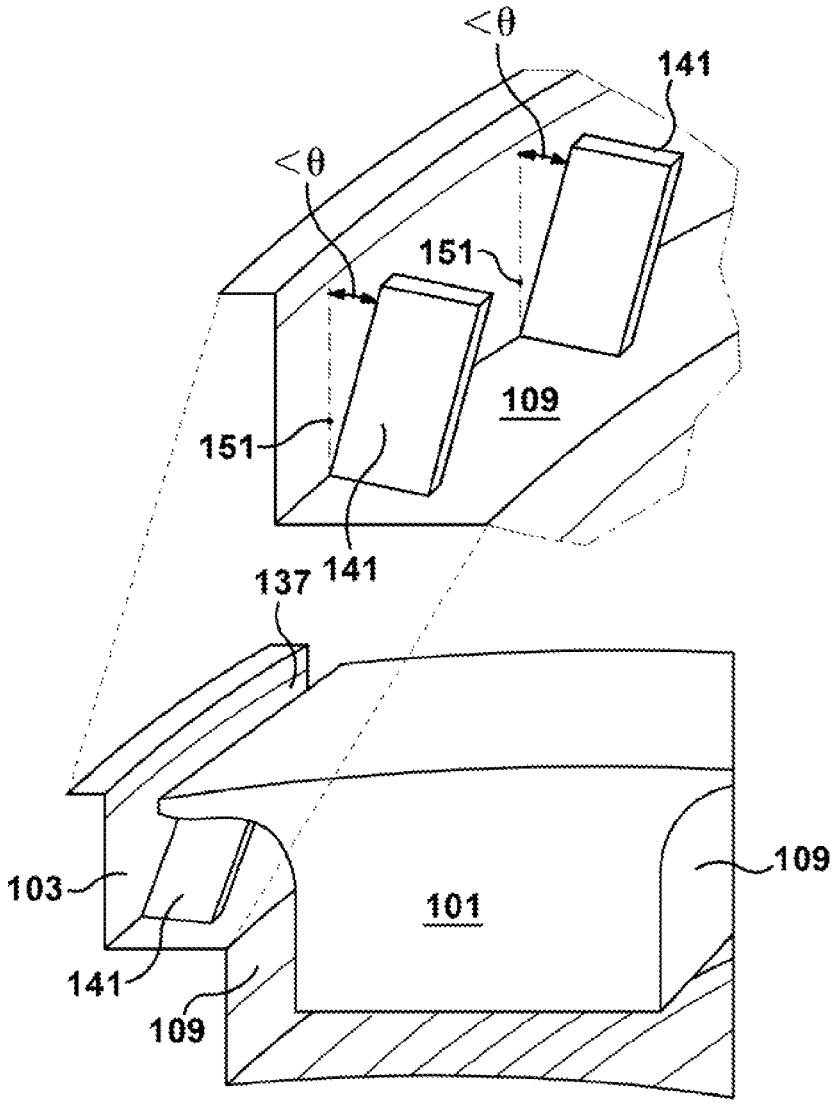
FIG. 6 is a view of a shroud cavity that includes an alternative embodiment of the present application.
Figure 7:
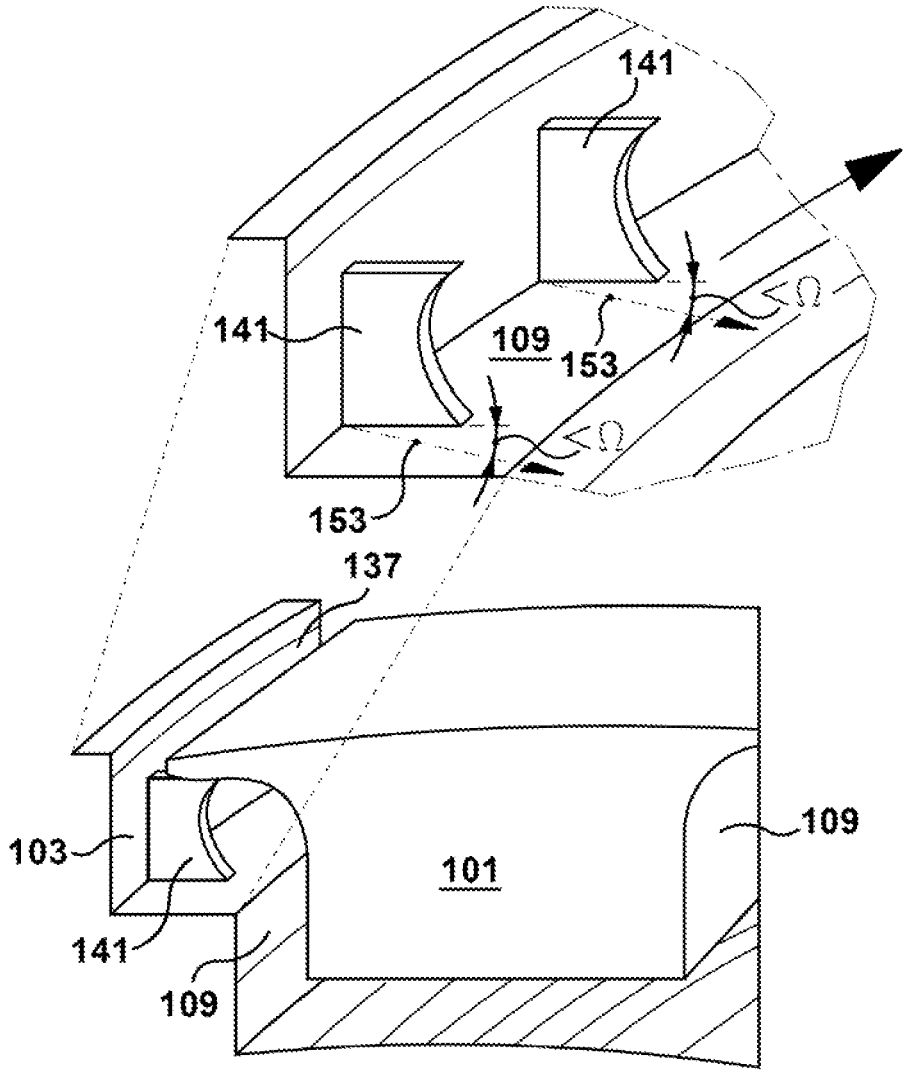
FIG. 7 is a view of a shroud cavity that includes an alternative embodiment of the present application.

Referring now to FIGS. 5 through 7, a similar shroud cavity 109 is shown that includes several examples of tangential flow inducers 141 according to embodiments of the present application. Tangential flow inducers 141, as provided herein, include surfaces that are configured such that, when rotated, induce at least a partial tangential directional component to and/or increase the velocity of the flow of leakage exiting the shroud cavity 109 via the upstream gap 137. As such, tangential flow inducers 141 may comprises many different shapes, the particular shape of which will be determined by the shape of the shroud cavity along the upstream side of the shroud. In general, tangential flow inducers 141 are formed to include a flat face, the plane of which is approximately aligned in a radial/axial plane (i.e., a plane that generally bisects the axis of the turbine). As discussed below, variations of this alignment are possible. That is, the flat face of the tangential flow inducer 141 may be skewed or offset slightly so that it forms an angle with a radially oriented reference line and/or an axially oriented reference line. Also, in some embodiments, though not shown, the tangential flow inducers 141 may include a slightly curved face. In some embodiments of this type, this curved face presents a concave shape toward the direction of rotation.

Another manner in which tangential flow inducers 141 may be described is the positional relationship they maintain in the upstream cavity portion 115 of the shroud cavity 109. As described, the upstream cavity portion 115 generally refers to the axial gap that is maintained between the leading face of the shroud 101 and the surface of the rotating structure 103 that opposes it. The upstream portion of the shroud cavity also is somewhat enclosed by a leading edge flange 121 that is positioned on the shroud 101, as shown in FIG. 4. As shown in the examples provided below, tangential flow inducers 141 may include fins that extend axially from the rotating structure 103 within the upstream cavity portion 115. These fins 141 are oriented so that they are approximately perpendicular to the circumferential direction, i.e., present a broad face (which may be flat or slightly curved) toward the direction of rotation. In some cases, as already stated, the upstream cavity portion 115 may include a step 125. In these cases, tangential flow inducers 141 also may include fins that extend radially from the surface of the step. In some preferred embodiments, the outer radial edge of the tangential flow inducer 141 may terminate inboard of the radial position of the leading edge flange 121. In this manner, contact between these two components may be avoided during changing operating conditions.

As shown in FIG. 5, in one embodiment, the tangential flow inducer 141 may include a fin 141 that is positioned within the upstream cavity portion 115. While the fin 141 may comprise many different shapes, as shown, it may have an "L" shape. This shape may perform well given the shape of the shroud 101 and the surrounding shroud cavity 109. The fin 141 may be oriented such that its flat face comprises a radial/axial plane. Given the perspective of FIG. 5, the bottom leg of the "L" may extend in an axial direction, while the top leg extends in a radial direction. The relatively thin thickness of the fin 141 generally extends in the circumferential direction, as shown.

It will be appreciated that this configuration and orientation creates an axial/radial plane, which, when rotated about the axis of the compressor as part of the rotating structure, would impart energy to the flow of leakage as the leakage exits the upstream gap 137. Given the rotation, it will be appreciated that this energy would impart a tangential directional component to the leakage as it exits and/or increase the velocity of the leakage, which would reduce the mixing losses that the flow incurs reentering the main flow.

Referring now to FIG. 6, an alternative embodiment of the tangential flow inducer 141 is shown. The fin 141 shown in FIG. 6 is similar to the shape of FIG. 5, but lacks the lower, axially extending leg that is shown in the other shape. However, the shape of the fin 141 of FIG. 6 also may be effective at imparting a desired flow direction and/or velocity to the exiting leakage, and may prove a better shape for some shroud cavities 109. FIG. 6 provides an example of a fin 141 having a face that is skewed or offset slightly from a radial/axial plane. As shown, the fin 141 extends in a direction that creates an $\angle\Theta$ with a radially oriented reference line 151. In some embodiments, offsetting the orientation of the fin 141 in this manner may be done so that the fin "leans" toward the direction of rotation. In other embodiments, offsetting the orientation of the fin 141 in this manner may be done so that the fin "leans" away the direction of rotation. In preferred embodiments, the fin 141 will be oriented such that $\angle\Theta$ is between approximately −20° and 20°. More preferably, the fin 141 will be oriented such that $\angle\Theta$ is between approximately −10° and 10°. It will be appreciated that this angle may be "tuned" so that the desired flow is created.

Referring now to FIG. 7, another alternative embodiment of the tangential flow inducer 141 is shown. In this case, the fin 141 includes an arcuate side. As described, many configurations are possible, and the fin 141 of FIG. 7 may be effective at imparting a desired tangential flow direction and/or velocity to the exiting leakage, and may prove a better shape for the shape of a particular shroud cavity 109. FIG. 7 provides another example of a fin 141 having a face that is skewed or offset slightly from a radial/axial plane. As shown, the fin 141 extends in a direction that creates an $\angle\Omega$ with an axially oriented reference line 153. Similar to FIG. 6 above, offsetting the orientation of the fin 141 in this manner may be done so that the fin "leans" toward the direction of rotation, or, offsetting the orientation of the fin 141 in this manner may be done so that the fin "leans" away the direction of rotation. In preferred embodiments, the fin 141 will be oriented such that $\angle\Omega$ is between approximately −20° and 20°. More preferably, the fin 141 will be oriented such that $\angle\Omega$ is between approximately −10° and 10°. It will be appreciated that this angle may be "tuned" so that the desired flow is created.

The tangential flow inducers 141 may be spaced circumferentially so that the desired leakage flow is achieved. Generally, a plurality of tangential flow inducers 141 will be spaced at regular intervals around the circumference of the rotating structure 103 to which they are attached. In addition, though forming the tangential flow inducers 141 as fins is a preferred embodiment, it will be appreciated that it is not a requirement.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, each possible iteration is not herein discussed in detail, though all combinations and possible embodiments embraced by the several claims below are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A compressor of a turbine engine, the compressor including stator blades with shrouds, the shrouds being surrounded, at least in part, by a rotating structure and forming a shroud cavity therebetween, the compressor comprising:

a plurality of tangential flow inducers disposed within the shroud cavity;

wherein each of the tangential flow inducers comprises a surface disposed on the rotating structure that is configured such that, when rotated, induces a tangential directional component to a flow of leakage exiting the shroud cavity via an upstream gap to reenter a main flow path of the compressor.

2. The compressor according to claim 1, wherein:

the rotating structure comprises components that rotate about the axis of the turbine during operation;

the stator blades comprise stationary components that include airfoils having a leading edge and a trailing edge and, at an inner radial end, the shrouds; and the upstream gap comprises a gap between an outer radial leading edge of the shroud and the rotating structure that opposes the outer radial leading edge of the shroud.

3. The compressor according to claim 1, wherein the shroud cavity comprises an upstream cavity portion that includes an axial gap maintained between a leading face of the shroud and a surface of the rotating structure that opposes the leading face of the shroud; and wherein the tangential flow inducers are disposed within the upstream cavity portion.

4. The compressor according to claim 3, wherein:

the upstream cavity portion is partially enclosed by a leading edge flange disposed on an outer radial leading edge of the shroud;

an outer radial edge of the tangential flow inducer terminates inboard of a radial position of an axial termination of the leading edge flange; and the rotating structure that opposes the leading face of the shroud comprises a step.

5. The compressor according to claim 3, wherein the shroud cavity comprises:

an intermediate cavity portion that comprises a radial gap between an inboard face of the shroud and a surface of the rotating structure that opposes the inboard face of the shroud; and a downstream cavity portion that comprises an axial gap between a trailing face of the shroud and a surface of the rotating structure that opposes the trailing face of the shroud;

wherein:

the upstream cavity portion, the intermediate cavity portion, and the downstream cavity portion are in fluid communication; and during an operating condition of the compressor, the flow of leakage comprises leakage that enters the shroud cavity via a downstream gap, then flows radially inward through the downstream cavity portion, then flows in an axial upstream direction through the intermediate cavity portion, then flows radially outward through the upstream cavity portion, then exits the shroud cavity via the upstream gap.

6. The compressor according to claim 5, wherein the tangential flow inducers comprise fins that include a face; and wherein the fins are configured such that the face approximately faces toward the direction of rotation.

7. The compressor according to claim 6, wherein the face is one of flat and slightly curved.

8. The compressor according to claim 6, wherein the fins extend axially from an approximately radially aligned surface of the rotating structure within the upstream cavity portion.

9. The compressor according to claim 6, wherein:

the upstream cavity portion comprises a step; and the fins extend radially from an approximately axially aligned surface of the step.

10. The compressor according to claim 6, wherein:

the fins comprise an approximate "L" shape;

a first leg of the "L" shape extends in an approximate axial direction;

the second leg of the "L" shape extends in an approximate radial direction; and a thickness of the fins extends in an approximate circumferential direction.

11. The compressor according to claim 6, wherein:

the orientation of the fins is offset in the radial direction such that the fins create an $\angle\Theta$ with a radially oriented reference line; and the $\angle\Theta$ comprises a value between −20° and 20°.

12. The compressor according to claim 11, wherein the $\angle\Theta$ comprises a value between −10° and 10°.

13. The compressor according to claim 11, wherein the $\angle\Theta$ comprises a value that provides desired flow characteristics to the flow of leakage.

14. The compressor according to claim 6, wherein the orientation of the fins is offset in the radial direction and the fins lean toward the direction of rotation of the rotating parts.

15. The compressor according to claim 6, wherein:

the orientation of the fins is offset in the axial direction such that the fins create an $\angle\Omega$ with an axially oriented reference line; and the $\angle\Omega$ comprises a value between −20° and 20°.

16. The compressor according to claim 15, wherein the $\angle\Omega$ comprises a value between −10° and 10°.

17. The compressor according to claim 15, wherein the $\angle\Omega$ comprises a value that provides desired flow characteristics to the flow of leakage.

18. The compressor according to claim 6, wherein the orientation of the fin is offset in the axial direction and the fins lean toward the direction of rotation of the rotating parts.

19. In a compressor of a turbine engine, the compressor including stator blades with shrouds, the shrouds being surrounded, at least in part, by a rotating structure and forming a shroud cavity therebetween, a plurality of flow inducers disposed at regular intervals on the rotating structure in the shroud cavity, each of the flow inducers comprising:

a fin that includes a face;

wherein:

the fin is configured such that the face faces toward the direction of rotation; and the fin is configured such that, when rotated, induces a tangential directional component to a flow of leakage exiting the shroud cavity flow;

wherein the shroud cavity comprises: an upstream cavity portion that includes an axial gap maintained between a leading face of the shroud and a surface of the rotating structure that opposes the leading face of the shroud; an intermediate cavity portion that comprises a radial gap between an inboard face of the shroud and a surface of the rotating structure that opposes the inboard face of the shroud; a downstream cavity portion that comprises an axial gap between a trailing face of the shroud and a surface of the rotating structure that opposes the trailing face of the shroud;

wherein the upstream cavity portion, the intermediate cavity portion, and the downstream cavity portion are in fluid communication;

wherein during an operating condition of the compressor, the flow of leakage comprises leakage that enters the shroud cavity via a downstream gap, then flows radially inward through the downstream cavity portion, then flows in an axial upstream direction through the intermediate cavity portion, then flows radially outward through the upstream cavity portion, then exits the shroud cavity via the upstream gap; and wherein the tangential flow inducers are disposed within the upstream cavity portion.

* * * * *